US011303026B2

(12) United States Patent
Gimersky

(10) Patent No.: US 11,303,026 B2
(45) Date of Patent: Apr. 12, 2022

(54) STACKED SELF-DIPLEXED DUAL-BAND PATCH ANTENNA

(71) Applicant: VIASAT, INC., Carlsbad, CA (US)

(72) Inventor: Martin Gimersky, Lausanne (CH)

(73) Assignee: Viasat, Inc., Carlsbad, CA (US)

( * ) Notice: Subject to any disclaimer, the term of this patent is extended or adjusted under 35 U.S.C. 154(b) by 723 days.

(21) Appl. No.: 15/780,362

(22) PCT Filed: Dec. 5, 2016

(86) PCT No.: PCT/US2016/064944
§ 371 (c)(1),
(2) Date: May 31, 2018

(87) PCT Pub. No.: WO2017/100126
PCT Pub. Date: Jun. 15, 2017

(65) Prior Publication Data
US 2018/0358701 A1 Dec. 13, 2018

Related U.S. Application Data

(60) Provisional application No. 62/265,190, filed on Dec. 9, 2015.

(51) Int. Cl.
*H01Q 5/50* (2015.01)
*H01Q 9/04* (2006.01)
(Continued)

(52) U.S. Cl.
CPC ..... *H01Q 5/50* (2015.01); *H01Q 1/523* (2013.01); *H01Q 9/0414* (2013.01);
(Continued)

(58) Field of Classification Search
CPC ..... H01Q 5/50; H01Q 9/0457; H01Q 21/28; H01Q 9/0442; H01Q 21/08; H01Q 9/16; H01Q 9/0435; H01Q 1/523; H01Q 9/0414
See application file for complete search history.

(56) References Cited

U.S. PATENT DOCUMENTS 5,153,600 A 10/1992 Metzler et al.
5,594,455 A * 1/1997 Hori ..... H01Q 9/0414 343/700 MS
(Continued)

FOREIGN PATENT DOCUMENTS

KR 10-2008-0079357 9/2008
KR 10-1014352 B1 2/2011
(Continued)

OTHER PUBLICATIONS

"Antenna to Antenna Isolation", https://www.antenna-theory.com/definitions/isolation.php, 2013 (Year: 2013).*
(Continued)

*Primary Examiner* — David E Lotter
(74) *Attorney, Agent, or Firm* — Holland & Hart LLP

(57) ABSTRACT

Disclosed is an antenna having an electrically conductive base. In some embodiments, a first radiating element (102) may overlie the electrically conductive base and be operative in a first frequency band. A second radiating element (104) may overlie the first radiating element (102) and have a footprint smaller than the first radiating element (102). The second radiating element (104) may be operative in a second frequency band. The second radiating element (104) may overlie the first radiating element (102) by a distance such that isolation between the feed lines of respective first and second radiating elements, in the first and second frequency bands, is greater than or equal to 15 dB.

19 Claims, 8 Drawing Sheets

(51) Int. Cl.

| | |
|---|---|
| ***H01Q 21/28*** | (2006.01) |
| ***H01Q 1/52*** | (2006.01) |
| ***H01Q 9/16*** | (2006.01) |
| ***H01Q 21/08*** | (2006.01) |

(52) U.S. Cl.

CPC ..... *H01Q 9/0435* (2013.01); *H01Q 9/0442* (2013.01); *H01Q 9/0457* (2013.01); *H01Q 9/16* (2013.01); *H01Q 21/08* (2013.01); *H01Q 21/28* (2013.01)

(56) References Cited

U.S. PATENT DOCUMENTS

| | | | | |
|---|---|---|---|---|
| 5,838,282 | A * | 11/1998 | Lalezari ..... | H01Q 21/26 343/727 |
| 6,639,558 | B2 * | 10/2003 | Kellerman ..... | H01Q 9/0414 343/700 MS |
| 7,884,685 | B2 | 2/2011 | Ozden | |
| 8,228,256 | B2 | 7/2012 | Puente Baliarda et al. | |
| 8,289,213 | B2 | 10/2012 | Duchesne et al. | |
| 8,354,972 | B2 | 1/2013 | Borja et al. | |
| 9,300,056 | B2 | 3/2016 | Lee et al. | |
| 2010/0134378 | A1 * | 6/2010 | Duchesne ..... | H01Q 9/0457 343/872 |
| 2016/0218439 | A1 * | 7/2016 | Fasenfest ..... | H01Q 21/065 |

FOREIGN PATENT DOCUMENTS

| | | | |
|---|---|---|---|
| WO | WO 2005/015689 | A1 | 2/2005 |
| WO | WO 2010/142780 | A1 | 12/2010 |
| WO | WO 2017/100126 | A1 | 6/2017 |

OTHER PUBLICATIONS

International Search Report and Written Opinion mailed in International (PCT) Application No. PCT/US2016/064944 dated Mar. 9, 2017, 10 pgs.

International Preliminary Report on Patentability mailed in International (PCT) Application No. PCT/US2016/064944 dated Jun. 21, 2018, 8 pgs.

Li et al., "Development and Analysis of a Folded Shorted-Patch Antenna With Reduced Size", IEEE Transactions on Antennas and Propagation, vol. 52, No. 2, Feb. 2004, pp. 555-562.

Lu et al., "A Mode-Based Design Method for Dual-Band and Self-Diplexing Antennas Using Double T-Stubs Loaded Aperture", IEEE Transactions on Antennas and Propagation, vol. 60, No. 12, Dec. 2012, pp. 5596-5603.

Hassan et al., "Patch and Ground Plane Design of Microstrip Antennas by Material Distribution Topology Optimization", Progress in Electromagnetics Research, vol. 59, 2014, pp. 89-102.

Montero-De-Paz et al., "Multifrequency Self-Diplexed Single Patch Antennas Loaded with Split Ring Resonators", Progress in Electromagnetics Research, vol. 113, 2011, pp. 47-66.

* cited by examiner

STACKED SELF-DIPLEXED DUAL-BAND PATCH ANTENNA

CROSS REFERENCE TO RELATED APPLICATIONS

Pursuant to 35 U.S.C. § 119(e), this application is entitled to and claims the benefit of the filing date of U.S. Provisional App. No. 62/265,190 filed 09 Dec. 2015, the content of which is incorporated herein by reference in its entirety for all purposes.

BACKGROUND

Dual-band operation in a patch antenna that uses the same polarization in both operating frequency bands typically includes separate sources, each providing a signal that occupies a respective disjoint frequency band. Each patch is operated with the same polarization. One (first) patch is driven relative to a ground plane. The other (second) patch is proximity-coupled to the first patch, and is thus parasitically driven by the first patch. Parasitic operation arises by virtue of the proximity of the second patch to the first patch. Electromagnetic fields radiated by the first patch induce surface currents on the second patch, and the induced currents make the second patch radiate as well. Since the frequency bands are disjoint, the patch antenna employs a diplexer to separate (on receive)/combine (on transmit) signals in the two disjoint frequency bands.

In order to obtain good input impedance matching, the first and second patches may be operated in resonance. As such, the electrical potential at the center of the first patch equals the electrical potential at the center of the second patch, as well as the electrical potential at the center of the ground plane. As a result, there is zero voltage between the centers of the first patch and the second patch. Since there is zero voltage, no electric current can flow between the points, even if the points are connected by an electrical conductor. This can be exploited in the mechanical construction of the antenna. A metallic stem/shaft may be driven through the centers of the first and second patches, thereby providing mechanical support for the patches without affecting electromagnetic (EM) properties of the antenna.

SUMMARY

In accordance with aspects of the present disclosure, an antenna may comprise an electrically conductive surface. A first radiating element may overlie the electrically conductive surface and may have a footprint smaller than the electrically conductive surface. The first radiating element may be operative in a first frequency band and may include a first feed line to communicate a first signal corresponding to a first polarization. A second radiating element may overlie the first radiating element and may have a footprint smaller than the first radiating element. The second radiating element may be operative in a second frequency band and may include a second feed line to communicate a second signal corresponding to the first polarization. The second radiating element may overlie the first radiating element by a distance such that isolation between the first and second feed lines in the first and second frequency bands is greater than or equal to 15 dB.

In some embodiments, the second radiating element may directly overlie the first radiating element.

In some embodiments, the footprint of the second radiating element may lie entirely within the footprint of the first radiating element.

In some embodiments, the distance between the first radiating element and the second radiating element may be in a range between one quarter wavelength of a frequency in the first frequency band and one quarter wavelength of a second frequency in the second frequency band.

In some embodiments, the distance between the first radiating element and the second radiating element may be equal to at most one quarter wavelength of a frequency in the first frequency band.

In some embodiments, the first and second frequency bands may be determined in part by respective dimensions of the first and second radiating elements.

In some embodiments, the first radiating element may comprise a first radiator and a second radiator overlying the first radiator. The first frequency band of the first radiating element may be based on a spacing between the first and second radiators of the first radiating element. In some embodiments, a footprint of the second radiator may be smaller than the first radiator and larger than the second radiating element.

In some embodiments, the second radiating element may comprise a first radiator and a second radiator overlying the first radiator. The second frequency band of the second radiating element may be based on a spacing between the first and second radiators of the second radiating element. In some embodiments, the antenna may further comprise a shorting pin connected to the first and second radiators of the second radiating element.

In some embodiments, the first and second radiating elements may be patches or dipoles.

In some embodiments, one of the first and second radiating elements is a patch and the other of the first and second radiating elements is a dipole.

In some embodiments, the antenna may further comprise a dielectric material disposed between the first and second radiating elements.

In accordance with aspects of the present disclosure, an antenna may comprise an electrically conductive base. A stack may be attached to the electrically conductive base. The stack may comprise a plurality of radiating elements overlying one another and having progressively smaller footprints; each radiating element may be associated with an operating frequency band. The antenna may include a plurality of feed lines, each feed line may be in communication with a respective radiating element to communicate signals in the operating frequency band of the respective radiating element according to a first polarization. The stack may have at least a first radiating element and an adjacent second radiating element respectively associated with a first frequency band and a second frequency band. The first and second radiating elements may be separated by a distance such that isolation between first and second feed lines respectively in communication with the first and second frequency bands is greater than or equal to 15 dB.

In some embodiments, the second radiating element may directly overlie the first radiating element.

In some embodiments, the footprint of the second radiating element may lie entirely within the footprint of the first radiating element.

In some embodiments, the distance between the first radiating element and the second radiating element may be in a range between one quarter wavelength of a frequency in the first frequency band and one quarter wavelength of a second frequency in the second frequency band.

In some embodiments, the distance between the first radiating element and the second radiating element may be at most one quarter wavelength of a frequency in the first frequency band.

In some embodiments, the first radiating element may comprise a first radiator and a second radiator overlying the first radiator. The first frequency band of the first radiating element may be based on a spacing between the first and second radiators of the first radiating element. In some embodiments, a footprint of the second radiator may be smaller than the first radiator and larger than the second radiating element.

In some embodiments, the second radiating element may comprise a first radiator and a second radiator overlying the first radiator. The second frequency band of the second radiating element may be based on a spacing between the first and second radiators the second radiating element. In some embodiments, a footprint of the first radiator may smaller than footprints of both the second radiator and the first radiating element.

In some embodiments, the first radiating element may be a patch or dipole and the second radiating element may be a patch or dipole.

In some embodiments, the stack may further include a third radiating element overlying the second radiating element and having a footprint smaller than the second radiating element. The third radiating element may be operative in a third frequency band. The third radiating element may include a third feed line to communicate a third signal corresponding to the first polarization.

In accordance with aspects of the present disclosure, an antenna may comprise a housing having a closed end and an open end opposite the closed end. A first radiating element may overlie a bottom surface of the closed end of the housing. The first radiating element may have a footprint smaller than the bottom surface of the housing and may be operative to communicate signals in a first frequency band. A first feed line may be in communication with the first radiating element, and operative to communicate signals with the first radiating element that correspond to a first polarization. A second radiating element may overlie the first radiating element and have a footprint smaller than the first radiating element. The second radiating element may be operative to communicate signals in a second frequency band. A second feed line may be in communication with the second radiating element, and operative to communicate signals with the second radiating element that correspond to the first polarization. The first and second radiating elements may be separated by a distance such that isolation between the first and second feed lines in the first and second frequency bands is greater than or equal to 15 dB.

In some embodiments, the distance between the first radiating element and the second radiating element may be in a range between one quarter wavelength of a frequency in the first frequency band and one quarter wavelength of a second frequency in the second frequency band.

In some embodiments, the distance between the first radiating element and the second radiating element may be at most one quarter wavelength of a frequency in the first frequency band.

In some embodiments, the first radiating element may comprise a first radiator and a second radiator overlying the first radiator. The first frequency band of the first radiating element may be based on a spacing between the first and second radiators of the first radiating element.

In some embodiments, the second radiating element may comprise a first radiator and a second radiator overlying the first radiator. The second frequency band of the second radiating element may be based on a spacing between the first and second radiators the second radiating In some embodiments, the antenna may further include a dielectric material disposed between the first radiating element and the second radiating element.

In accordance with aspects of the present disclosure, an antenna may comprise an electrically conductive surface. The antennas may include a first radiating element overlying the electrically conductive surface and having a footprint smaller than the electrically conductive surface, the first radiating element operative in a first frequency band, the first radiating element including a first feed line to communicate a first signal corresponding to a first polarization. A second radiating element may overlie the first radiating element and have a footprint smaller than the first radiating element, the second radiating element operative in a second frequency band, the second radiating element including a second feed line to communicate a second signal corresponding to the first polarization. The distance between the first radiating element and the second radiating element may be in a range between one quarter wavelength of a first frequency in the first frequency band and one quarter wavelength of a second frequency in the second frequency band.

In some embodiments, the second radiating element may directly overlie the first radiating element.

In some embodiments, the footprint of the second radiating element may lie entirely within the footprint of the first radiating element.

In some embodiments, isolation between the first and second feed lines in the first and second frequency bands may be greater than or equal to 15 dB.

In some embodiments, the distance between the first radiating element and the second radiating element may be equal to at most one quarter wavelength of a first frequency in the first frequency band.

In some embodiments, the first and second frequency bands may be determined in part by respective dimensions of the first and second radiating elements.

In some embodiments, the first radiating element may comprise a first radiator and a second radiator overlying the first radiator. The first frequency band of the first radiating element may be based on a spacing between the first and second radiators of the first radiating element. A footprint of the second radiator may be smaller than the first radiator and larger than the second radiating element.

In some embodiments, the second radiating element may comprise a first radiator and a second radiator overlying the first radiator. The second frequency band of the second radiating element may be based on a spacing between the first and second radiators of the second radiating element. A shorting pin may be connected to the first and second radiators of the second radiating element.

In some embodiments, the first and second radiating elements may be patches or dipoles.

In some embodiments, one of the first and second radiating elements may be a patch and the other of the first and second radiating elements may be a dipole.

In some embodiments, the antenna may further comprise a dielectric material disposed between the first and second radiating elements.

The following detailed description and accompanying drawings provide further understanding of the nature and advantages of the present disclosure.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, makes apparent to those of skill in the art how embodiments in accordance with the present disclosure may be practiced. Similar or same reference numbers may be used to identify or otherwise refer to similar or same elements in the various drawings and supporting descriptions. In the accompanying drawings.

DETAILED DESCRIPTION

In the following description, for purposes of explanation, numerous examples and specific details are set forth in order to provide a thorough understanding of the present disclosure. It will be evident, however, to one skilled in the art that the present disclosure, as expressed in the claims, may include some or all of the features in these examples, alone or in combination with other features described below, and may further include modifications and equivalents of the features and concepts described herein.

Stacked Patch Antenna

Figure 1:
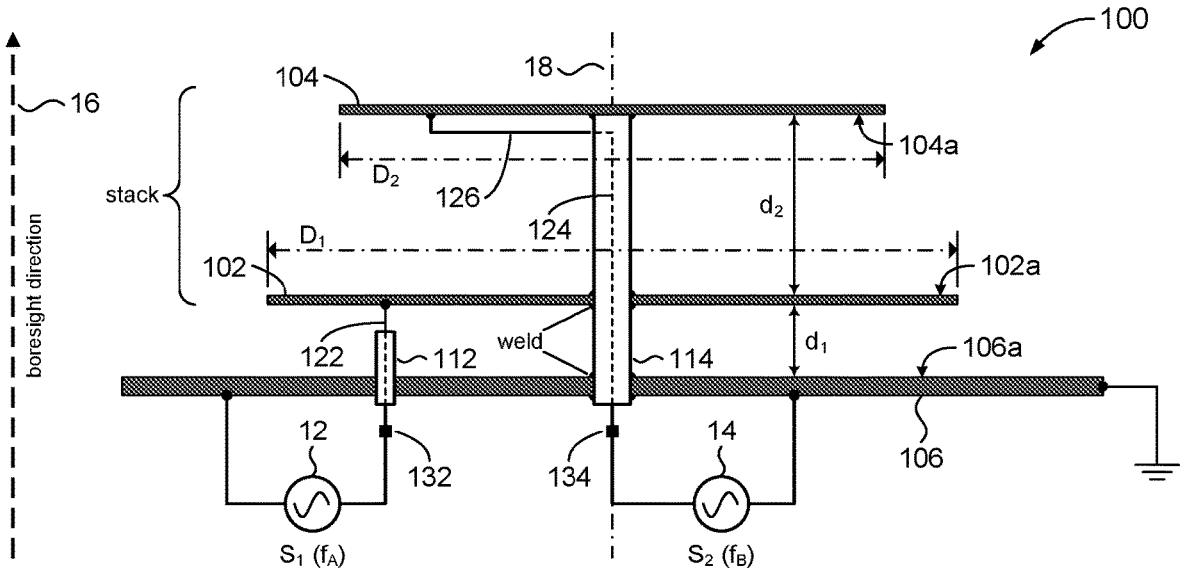
FIGS. 1 and 1A illustrate a high level diagram of a stacked self-diplexed antenna in accordance with the present disclosure.

FIG. 1 is a high level schematic representation of a stacked patch antenna 100 in accordance with aspects of the present disclosure. The antenna 100 may include a base (base plate) 106. The base 106 may have an electrically conductive surface 106*a* that can be referenced to a reference potential (e.g., ground) for antenna operation. In some embodiments, the base 106 may be an electrically conductive material such as copper, aluminum, etc., alloys of electrically conductive materials, and so on. In other embodiments, the base 106 may comprise an electrically non-conductive material that is coated with an electrically conductive material.

The antenna 100 may include a stack of radiating elements comprising at least a first radiating element 102 and a second radiating element 104. Each radiating element 102, 104 may comprise a suitable electrically conductive material such as copper, aluminum, etc., alloys of electrically conductive materials, and so on. In some embodiments, the radiating elements 102, 104 may be patch antennas (patches). The patches may be circular or elliptical in shape, square-shaped, rectangular, triangular, and in general may have any suitable shape. In other embodiments, the radiating elements 102, 104 may be dipole antennas (dipoles). In some embodiments, radiating element 102 may be a patch and radiating element 104 may be a dipole, and vice versa. To avoid overly complicating the description, the remaining disclosure will assume, without loss of generality, embodiments configured with a circular base (e.g., base 106) and circular patches (e.g., radiating elements 102, 104).

In accordance with the present disclosure, the stack of radiating elements (e.g., radiating elements 102, 104) may overlie one another in the boresight direction 16 of antenna 100. The boresight direction 16, for example, may refer to the direction of maximum gain of a beam of the antenna 100. FIG. 1 shows that radiating element 104 is stacked relative to the radiating element 102 in the boresight direction 16; accordingly, radiating element 104 is deemed to "overlie" radiating element 102. In some embodiments, the radiating element 102 may be spaced apart from the surface 106*a* of base 106 in the boresight direction 16 by a separation distance (spacing) $d_1$. Similarly, the radiating element 104 may be spaced apart from the radiating element 102 in the boresight direction 16 by a distance $d_2$.

Figure 1A:
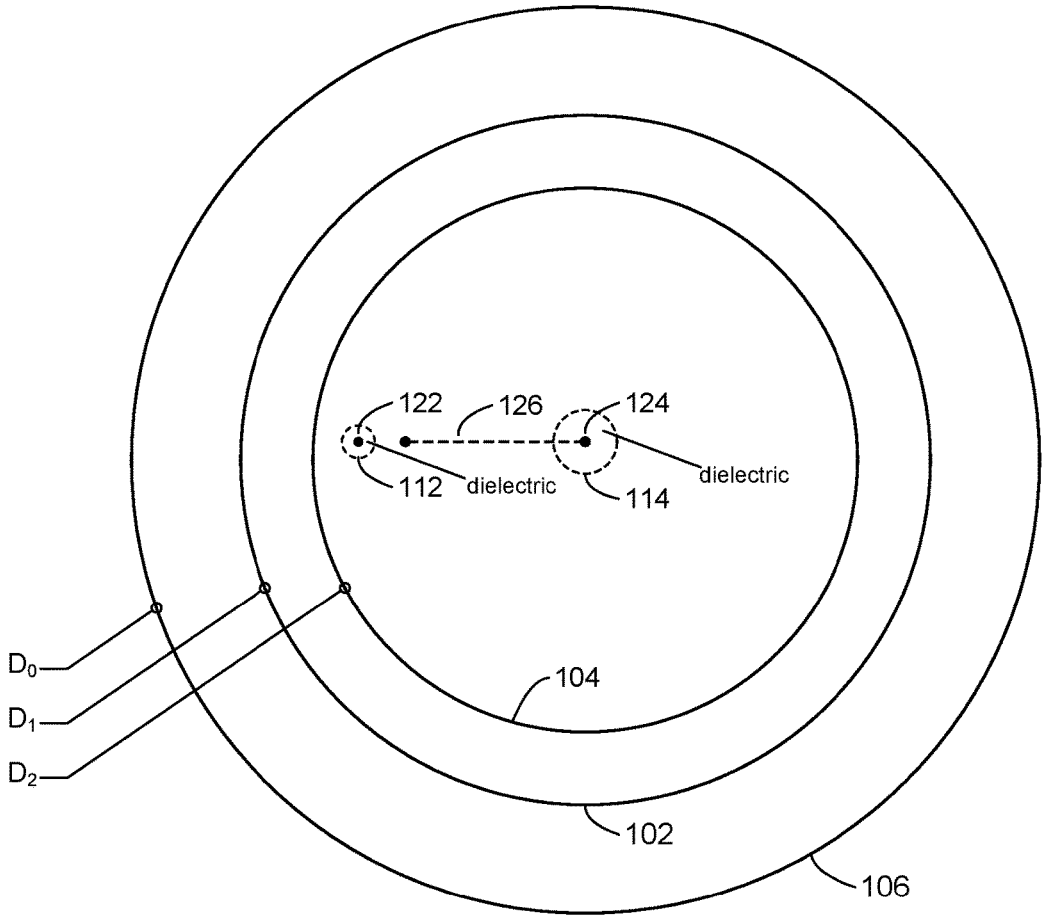

In accordance with the present disclosure the radiating elements that comprise a stack may have progressively smaller footprints in the boresight direction 16. The term "footprint" may be defined as a projection of an object onto a plane. FIG. 1A, for example, shows an example of base 106, which when projected onto a plane produces circular footprint having a diameter $D_0$. The radiating elements 102, 104 are shown projected onto the surface 106*a* of the base 106 to reveal circular footprints having respective diameters $D_1$, $D_2$. The footprint of radiating element 102 may be smaller than that of the base 106 (e.g., $D_0<D_1$). In accordance with the present disclosure, the footprint of radiating element 104 is smaller than radiating element 102 (e.g., $D_2<D_1$).

Figure 1B:
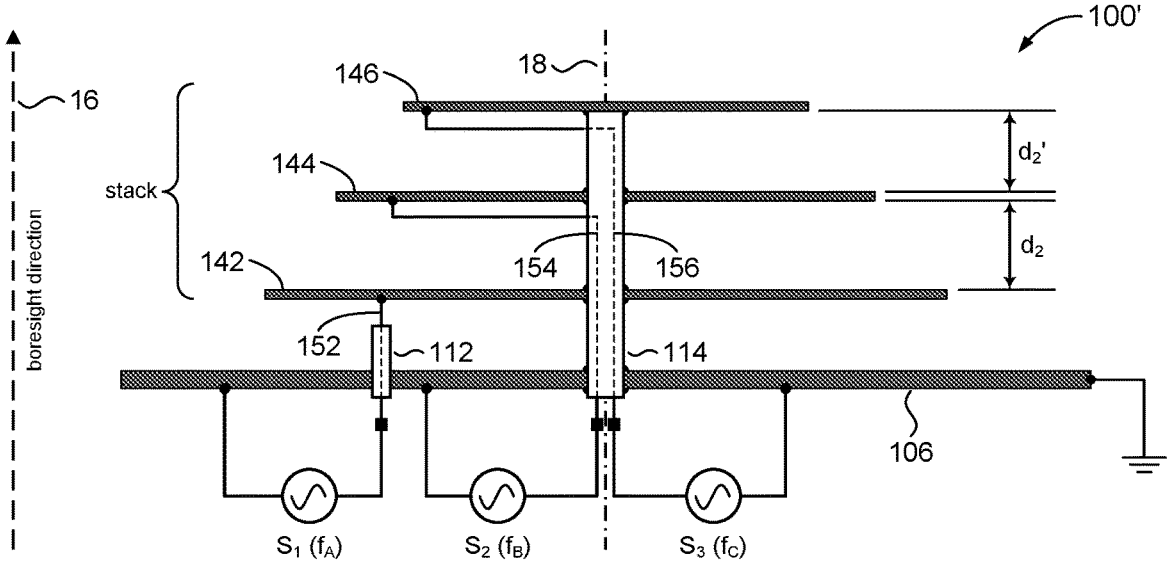
FIG. 1B shows an illustrative example of a multi-stacked self-diplexed antenna in accordance with the present disclosure.

In some embodiments, the stack of radiating elements may comprise number of radiating elements stacked in the boresight direction 16 and having progressively smaller footprints in the boresight direction 16. FIG. 1B, for example, shows an antenna 100' in accordance with the present disclosure comprising a stack having three radiating elements 142, 144, 146 of decreasing footprints in the boresight direction 16. In other embodiments (not shown), the stack may comprise additional radiating elements. The radiating elements 142, 144, 146 may be fed via respective feed lines 152, 154, 156.

Continuing with FIGS. 1 and 1A, in some embodiments, the radiating elements 102, 104 may directly overlie one another. For example, the centers of radiating elements 102, 104 are shown aligned along a longitudinal axis 18 of the antenna 100. Accordingly, radiating element 104 may be said to "directly overlie" radiating element 102.

In some embodiments, the footprints of one radiating element may lie entirely within the footprint of an underlying radiating element. FIG. 1A, for example, shows the footprint of radiating element 104 to be completely surrounded by the footprint of an underlying radiating element 102, and thus may be said to lie "entirely within" the footprint of radiating element 102. The footprint of radiating element 102, likewise, lies entirely within the footprint of base 106.

The antenna 100 may include a coaxial transmission line 112 connected to a port 132 (e.g., provided at base 106) and extending through the base 106 to feed the radiating element 102. In some embodiments, for example, the coaxial transmission line 112 may include a feed line (feeding transmission line) 122 encased or otherwise supported in an insulative dielectric medium, and connected to the port 132. The dielectric medium in the coaxial transmission line 112 may comprise any suitable dielectric material. The feed line 122 may be connected to the radiating element 102 for signal communication between its port 132 and the radiating element 102. For example, radiating element 102 may be driven by a signal (e.g., from a signal source 12) provided at port 132 of the feed line 122. Conversely electromagnetic (EM) fields received by radiating element 102 may be sensed at port 132. The radial location of the attachment point of the feed line 122 to the radiating element 102 is typically determined by the need to provide the best input impedance match for the radiating element 102, as is commonly understood by anyone knowledgeable in the state of the art.

The antenna 100 may include a center support tube 114 comprising an electrically conductive material. The center support 114 may be connected to the base 106 along axis 18 to provide mechanical support for the radiating elements 102, 104 and to elevate them above the base 106. For example, the radiating elements 102, 104 may be spot welded to the center support 114. The center support 114 can provide sufficient rigidity to support the radiating elements 102, 104 under high mechanical load conditions. For example, in a satellite application, the center support 114 can be mechanically robust in order to withstand the shock and vibrations experienced during spacecraft launch.

In some embodiments, the center support 114 may also serve as the outer conductor of a coaxial transmission line to feed radiating element 104. In some embodiments, for example, the center support 114 includes a feed line (center conductor) 124 encased or otherwise supported in a suitable insulative dielectric medium, and connected to a port 134 provided at the base 106. The feed line 124 may break out near the top of the center support 114 and transition to a breakout wire feed line (feeding transmission line) 126 to feed the radiating element 104. In some embodiments, for example, the breakout wire feed line 126 may be viewed as a microstrip line that is spaced apart from the bottom surface 104*a* of the radiating element 104 and runs along the bottom surface 104*a* from the center support 114 toward the periphery of radiating element 104. The radiating element 104 can be driven by a signal (e.g., signal source 14) provided at the port 134 of feed line 124 to transmit an EM field, and vice versa, EM fields received by radiating element 104 may be sensed at port 134. As with feed line 122, the radial location of the attachment point of the feed line 126 to the radiating element 104 is typically determined by the need to provide the best input impedance match for the radiating element 104, as is commonly understood by anyone knowledgeable in the state of the art.

Operational Aspects of Stacked Patch Antenna

The discussion will now turn to some operational aspects of antenna 100. The radiating element 102 resonates at a resonant frequency $f_A$, and may be operable within an operating frequency band (frequency band) centered around the resonant frequency $f_A$. The resonant frequency $f_A$ of the radiating element 102, for example, may be established by design parameters of the radiating element 102 such as its shape and dimensions. The resonant frequency $f_A$ of radiating element 102 may also be established by its distance $d_1$ from the base 106. The radiating element 104, likewise, resonates at a resonant frequency $f_B$ that can be established by its shape and dimensions, and may operate within an operating frequency band centered around the resonant frequency $f_B$. Since radiating element 102 is larger than radiating element 104 ($D_1>D_2$), radiating element 102 will resonate at a lower resonant frequency $f_A$ than the resonant frequency $f_B$ of radiating element 104.

Resonant frequency may also be established based on the location of the signal feed on the radiating element. In the case of a rectangular patch antenna (radiating element), for example, if the patch is fed at a point along the diagonal of the rectangle, the surface current at resonance oscillates along the diagonal, whose length is:

$$\text{path length}=\sqrt{A2+B2},$$

where A and B are the patch length and width, respectively. If, on the other hand, the same patch is fed at the center of an edge (along the patch width, for example), the surface current at resonance oscillates along the other edge (patch length in this case, where path length=A). The two different surface current path lengths yield two different resonant frequencies.

Resonant frequency may also be established by the way the signal is applied to the radiating element. For example, if the direct metallic connection of the feed line (e.g., feed line 122) to the radiating element does not result in good input impedance match, the introduction of a small gap between the feed line and the radiating element (to introduce a capacitance), may be enough to achieve the desired impedance match of the antenna; this is sometimes referred to as feeding by capacitive coupling. A side effect of capacitive coupling is a slight shift in the resonant frequency of the radiating element.

As explained above, the radiating elements 102, 104 are connected to center support 114 for mechanical support. In some embodiments, center support 114 may comprise an electrically conductive material, which may be at ground potential by virtue of its connection to grounded base 106. Since the radiating elements 102, 104 may be operated at their respective resonance frequencies $f_A$, $f_B$, the electrical voltage between their respective centers can be negligible (theoretically zero). Therefore, the connection of radiating elements 102, 104 to the electrically conductive grounded center support 114 can have little to no impact on EM fields communicated by radiating elements 102, 104, so long as the diameter of center support 114 is not excessive.

The operating frequency band of a radiating element (e.g., radiating element 102) comprises an overlap of several constituent bandwidths associated with that radiating element. One such constituent, for example, is the input impedance bandwidth which refers to the bandwidth over which the input impedance of the radiating element is sufficiently well matched to the characteristic impedance of the feed line (e.g., feed line 122). In the case of radiating elements 102, 104, the impedance bandwidth is the bandwidth within which the radiating element resonates. At frequencies outside of the band within which the radiating element resonates, the radiating element does not radiate: all the power fed to the radiating element via the feed line is reflected back to the signal source (e.g., signal source 12). Other constituents of the operating frequency band include a radiation pattern bandwidth. The radiation pattern bandwidth refers to the bandwidth within which the radiating element has a given or desired radiation pattern, for example, a peak gain over a certain value, say 8 dB. Polarization bandwidth refers to the bandwidth over which the radiating element has desired polarization properties, which may be expressed, for example, by cross-polarized radiation being less than a certain level, say 30 dB, below the peak of the co-polarized radiation. In most cases, however, the operating frequency band of a radiating element is determined by the input impedance bandwidth.

In accordance with the present disclosure, antenna 100 is operable as a self-diplexing antenna. For example, the antenna 100 may be fed two or more signals, directly without the use of a diplexer, that correspond to the same polarization (e.g., right-circular polarization) and have non-overlapping bandwidths to transmit an EM field that contains a combination of those two or more signals. Conversely, by the reciprocity theorem of electromagnetics, the antenna 100 may receive an EM field containing a combination of two (or more) signals of non-overlapping bandwidths to produce two (or more) separate signals corresponding to the same polarization from the received EM field without the use of a diplexer. FIG. 1, for example, shows separate signals $S_1$ and $S_2$ from respective signal sources 12, 14. One signal (e.g., $S_1$) may be fed directly (i.e., no diplexer) to its corresponding radiating element (e.g., 102) using a given polarization (e.g., right-circular polarization), and the other signal (e.g., $S_2$) may be fed directly (i.e., no diplexer) to its corresponding radiating element (e.g., 104) using the same polarization in a self-diplexed manner, i.e., without the two signals mutually interfering with each other.

A self-diplexing antenna may be characterized by the response detected at its ports to signals applied at its ports. With respect to FIG. 1, for example, antenna 100 may be deemed to be self-diplexing when signal $S_1$ is applied to port 132 to drive radiating element 102 and no signal (in principle) is detected at port 134 of radiating element 104. Conversely, when signal $S_2$ is fed to radiating element 104, no signal (in principle) should be detected at the port 132 of radiating element 102. In dual-band antennas that operate with mutually-orthogonal polarizations, i.e., the operating polarization in one frequency band is orthogonal to the operating polarization in the other frequency band, self-diplexing is achieved directly by the virtue of polarization orthogonality. In contrast, the present disclosure describes an antenna that operates with the same polarization in both frequency bands (i.e., the operating polarizations are identical, aligned), and self-diplexing is achieved by EM isolation, as opposed to polarization orthogonality. More generally, antennas in accordance with the present disclosure may operate with the same polarization in multiple frequency bands (i.e., the operating polarizations are identical, aligned), and self-multiplexing is achieved by EM isolation, as opposed to polarization orthogonality.

This self-diplexing property of antenna 100 may be explained in terms of the EM fields that arise from the radiating elements 102, 104 when they are driven. Consider radiating element 102, for example. When radiating element 102 is driven by a signal in an operating frequency band that includes the resonant frequency $f_A$ of radiating element 102, the tangential component of the electric field on the upper surface 102*a* of radiating element 102 will be at minimum (zero if the radiating element 102 was made of a perfect electric conductor). At a location one quarter wavelength above the upper surface 102*a*, the tangential component of the magnetic field will be will be at minimum. If the radiating element 104 is spaced apart from the radiating element 102 so that the bottom surface 104*a* is positioned (distance $d_2$) above the upper surface 102*a* by a quarter wavelength of the frequency of the signal that is fed to radiating element 102, then the magnetic field that emanates from radiating element 102 may not induce an electric current on the surface of the radiating element 104; port 134 should not exhibit any signal in an operating frequency band that includes the resonant frequency $f_A$ of radiating element 102, and should exhibit only a substantially reduced signal in an operating frequency band that includes the resonant frequency $f_B$ of radiating element 104, when radiating element 102 is driven.

Likewise, for radiating element 104. When radiating element 104 is driven by a signal in the operating frequency band of radiating element 104, the tangential component of the electric field on the bottom surface 104*a* of radiating element 104 will be minimum (zero if the radiating element 104 was made of a perfect electric conductor). A quarter wavelength below the bottom surface 104*a*, the tangential component of the magnetic field will be minimum. If the radiating element 104 is spaced apart from the radiating element 102 so that the bottom surface 104*a* is positioned (distance $d_2$) above the upper surface 102*a* by a quarter wavelength of the frequency of the signal that is fed to radiating element 104, then the magnetic field from radiating element 104 may not induce an electric current in radiating element 102, port 132 should not exhibit any signal in the operating frequency band of radiating element 104, and should exhibit only a substantially reduced signal in an operating frequency band of radiating element 102, when radiating element 104 is driven.

As explained above, ideal self-diplexing behavior—i.e., zero response observed at port 134 across the operating frequency band of radiating element 104 when radiating element 102 is fed, and vice-versa zero response observed at port 132 across the operating frequency band of radiating element 102 when radiating element 104 is fed—may not be realizable in practice, due to the fact the two operating frequency bands are not overlapping. However, in accordance with some embodiments of the present disclosure, self-diplexing equal to or greater than 15 dB in both operating frequency bands of antenna 100 is achievable, as will be shown below, and may be deemed to be adequate for a given application of antenna 100. In other words, the signal isolation between the feed lines 122, 124 (e.g., determined at respective ports 132, 134) may be greater than or equal to 15 dB. For example, in an antenna 100 in accordance with some embodiments, a driving signal applied at one port (e.g., port 132 of feed line 122) may produce a response signal at the other port (e.g., port 134 of feed line 124) that is 15-20 dB less than the driving signal. A response signal that is 15 dB below the peak of the driving signal means that only about 3.2% of the power of the driving signal appears at the non-driven port.

In accordance with the present disclosure, the radiating element 104 may be separated from radiating element 102 by a distance $d_2$ such that the isolation between port 132 of feed line 122 and port 134 of feed line 124 is greater than or equal to 15 dB. Accordingly, in some embodiments, for example, the distance $d_2$ between radiating elements 102, 104 may be equal to or greater than a quarter wavelength of the resonant frequency $f_A$ of radiating element 102. In other words, a minimum distance $d_2$ may be established by the longest wavelength, namely the wavelength of resonant frequency $f_A$. Referring to FIG. 1, the distance $d_2$ in accordance with the present disclosure may be measured between the upper surface 102*a* of radiating element 102 and the bottom surface 104*a* of radiating element 104. In other embodiments, the distance $d_2$ between radiating elements 102, 104 may be in the range of a quarter wavelength of the resonant frequency $f_A$ of radiating element 102 and a quarter wavelength of the resonant frequency $f_B$ of radiating element 104.

Operation of antenna 100 may further be described in terms of the transmission of signals $S_1$, $S_2$. It will be understood that the discussion can be applied to the reciprocal operation of receiving signals. In accordance with the present disclosure, the base 106 may serve as a ground plane that is operative with radiating element 102 to provide a reference plane (e.g., a ground plane) for the transmission/reception (communication) of EM radiation by radiating element 102. In order to provide directionality for radiating element 102, the reference plane provided by base 106 has a larger footprint than the footprint of radiating element 102, as can be seen for example in FIGS. 1 and 1A.

Further in accordance with the present disclosure, radiating element 102 in turn may be operative with radiating element 104 to provide a reference plane (e.g., ground plane) for the transmission/reception of EM radiation by radiating element 104. Directionality for radiating element 104 is achieved by the fact that radiating element 102 (acting as a reference plane) has a larger footprint than radiating element 104, as can be seen in FIGS. 1 and 1A.

Radiating elements 102, 104 in accordance with the present disclosure may be directly driven (i.e., absent the use of a diplexer) by respective signal sources 12, 14, as noted above. In other words, signals from signal source 12 may be fed to radiating element 102 without the use of a diplexer. One of ordinary skill will appreciate, however, that there may be intervening circuitry between radiating element 102 and signal source 12, such as couplers, filters, or other such signal conditioning circuits. Similarly, signals from signal source 14 may be fed to radiating element 104 without the use of a diplexer, with the same caveat regarding intervening circuitry between radiating element 104 and signal source 14.

Initial Design Concept

Figure 2:
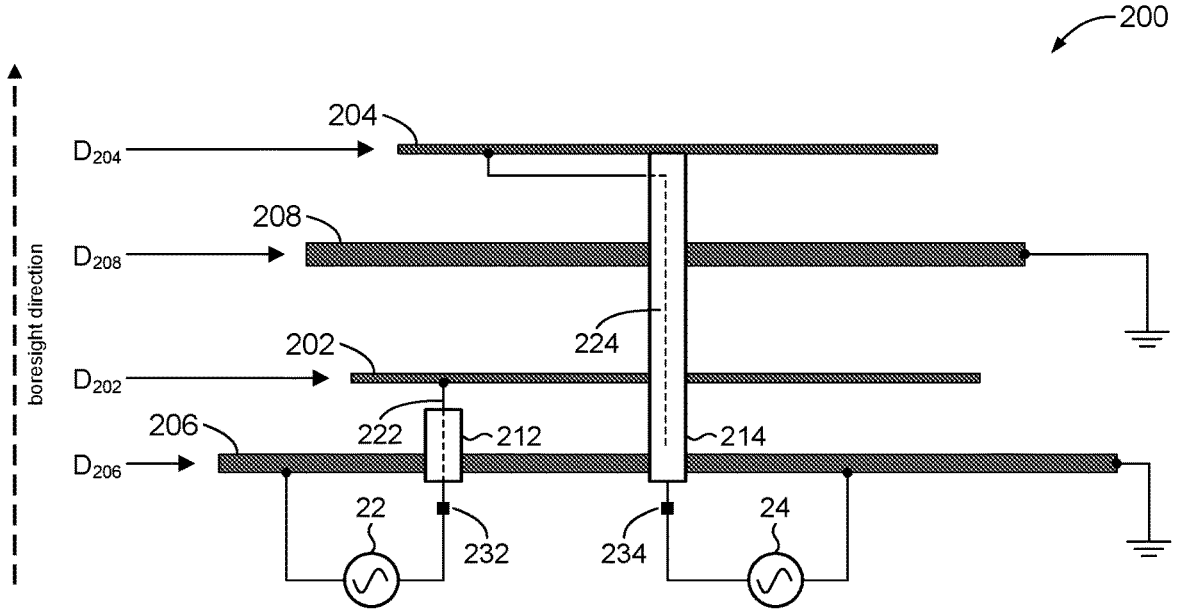
FIG. 2 shows an initial design of an antenna of the present disclosure.

FIG. 2 shows the design for a self-diplexing antenna 200 initially conceived and considered by the inventor named herein. The antenna 200 includes a base 206 and radiating elements 202, 204 supported above the base 206 by a center support 224. The base 206 has a circular footprint, and the radiating elements 202, 204 are circular patch antennas. A ground plane 208 is provided between radiating elements 202, 204, and also has a circular footprint.

Radiating element 202 may be fed (e.g., via source 22) by a transmission line 212 comprising a feed line 222 having a port 232 provided through base 206. The center support 214 may serve as a transmission line to feed radiating element 204; e.g., via source 24. The center support 214 may include a feed line 224 having a port 234 to feed radiating element 204.

Base 206 may serve as a ground plane that is operative with radiating element 202 to provide a reference plane for the transmission/reception of EM radiation by radiating element 202. In order to provide directionality for radiating element 202, the footprint of base 206 is larger than the footprint of radiating element 202. For example, the diameter $D_{206}$ of base 206 is larger than the diameter $D_{202}$ of radiating element 202.

In like fashion, ground plane 208 is operative with radiating element 204 to provide a reference plane for the transmission/reception of EM radiation by radiating element 204. Directionality for radiating element 204 is achieved by providing ground plane 208 with a larger footprint than for radiating element 204. For example, the diameter $D_{208}$ of ground plane 208 is larger than the diameter $D_{204}$ of radiating element 204.

Radiating elements 202, 204 may be directly driven (i.e., absent the use of a diplexer) by respective signal sources 22, 24, for self-diplexed communication (e.g., transmission) of signals associated with the same polarization. In other words, signals from signal source 22 may be fed to radiating element 202 without the use of a diplexer; although it will be understood that there may be intervening circuitry between radiating element 202 and signal source 22, such as couplers, filters, or other such signal conditioning circuits. Similarly, signals from signal source 24 may be fed to radiating element 204 without the use of a diplexer, and with the same caveat regarding intervening circuitry between radiating element 204 and signal source 24. Self-diplexed dual-band operation may be realized when signal source 22 feeds signals to radiating element 202 in an operating frequency band different from the operating frequency band of signals fed by signal source 24 to radiating element 204.

The inventor named herein observed that the configuration of antenna 200 as depicted in FIG. 2 can exhibit certain operational limitations. For example, EM fields radiated by radiating element 202 in the boresight direction may be obscured by the ground plane 208, thus limiting the efficacy of transmissions made by radiating element 202. Conversely, ground plane 208 may block radiating element 202 from incoming EM fields, thus limiting the ability of radiating element 202 to receive transmissions. The inventor named herein, deemed that this configuration of antenna 200, which employs ground plane 208, was unsuitable for antennas using stacked self-diplexed dual-band designs.

By comparison with FIG. 1, antenna 100 in accordance with the present disclosure omits the ground plane 208 used in antenna 200. While the base 106 in antenna 100 serves as a reference plane for radiating element 102 (as in the case of antenna 200), the reference plane for the radiating element 104 is radiating element 102 itself, rather than a separately provided ground plane (as in the case of antenna 200). The absence of a separate ground plane for radiating element 104 considerably reduces the obstruction of EM fields that radiate from radiating element 102 for transmission and EM fields received by radiating element 102 for signal reception, thus allowing for stacked designs. For example, using radiating element 102 as a reference plane for radiating element 104 allows for a stacked self-diplexed dual-band design, such as shown in FIG. 1.

In addition, stacked self-multiplexed multi-band designs may be embodied by employing additional radiating elements in the same manner FIG. 1B, for example, shows an antenna 100' in accordance with the present disclosure that can provide multi-band operation. Antenna 100' may comprise a radiating element 142 that may be driven in one operating frequency band that includes a resonant frequency $f_A$. The antenna 100' may comprise another radiating element 144 that may be driven in another operating frequency band that includes resonant frequency $f_B$, and yet another radiating element 146 driven in yet another operating frequency band that includes resonant frequency $f_C$.

The antenna 100' can exhibit self-multiplexing behavior, by separating the radiating elements 142, 144, 146 with appropriate distances $d_2$, $d_2'$, allowing for the radiating elements 142, 144, 146 to be driven by respective signal sources $S_1$, $S_2$, $S_3$ without the use of multiplexing circuitry.

Moreover, base 106 can serve as the reference plane for radiating element 142. Radiating element 142, in turn, may serve as the reference plane for radiating element 144, and radiating element 144, in turn, may serve as the reference plane for radiating element 146. The inclusion of separately provided reference planes for radiating elements 144, 146 is obviated, making the stacking configuration of antenna 100' a feasible self-multiplexed multi-band design.

ADDITIONAL EMBODIMENTS

Figure 3:
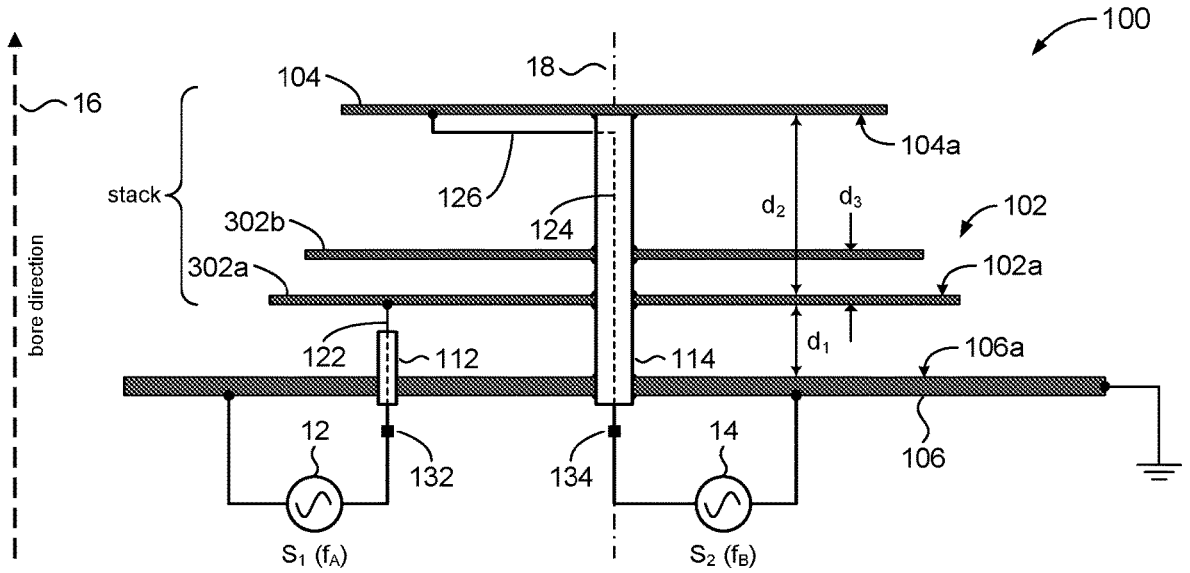
FIGS. 3 and 3A illustrate another embodiment of a stacked self-diplexed antenna in accordance with the present disclosure.
Figure 3A:
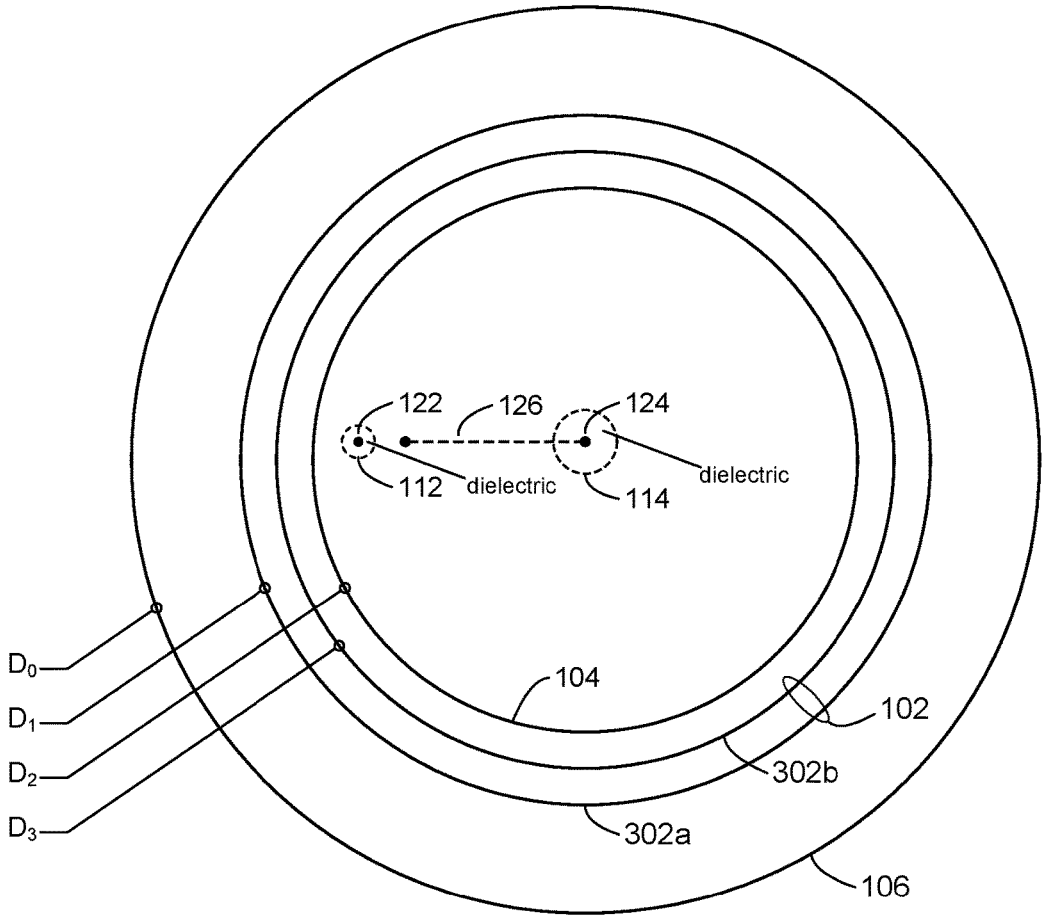

As explained above, the operating frequency bands of radiating elements 102, 104 are largely a function of the input impedance bandwidth. In accordance with the present disclosure, the operating frequency band of radiating element 102 may be further tuned by the inclusion of a parasitic patch. Referring to FIGS. 3 and 3A, for example, in some embodiments, the radiating element 102 may comprise a driven patch 302*a* and a parasitic patch 302*b* that is stacked relative to the driven patch 302*a* in the boresight direction 16. The patches 302*a*, 302*b* of radiating element 102 may be mechanically supported by the center support 114, and may comprise any suitable electrically conductive material. The driven patch 302*a* may be fed by the feed line 122 connected to the driven patch 302*a*. The parasitic patch 302*b* may be fed parasitically by virtue of its proximity to the driven patch 302*a*, being electromagnetically coupled to the driven patch 302*a*.

The driven and parasitic patches 302*a*, 302*b* that comprise radiating element 102 may be tuned to define respective resonances of the electric currents on the surfaces of the patches 302*a*, 302*b* to establish a desired operating frequency band for radiating element 102. For example, the tuning may include patch designs in terms of shape, dimensions, etc., spacing (e.g., spacing $d_3$) between patches 302*a*, 302*b*, and spacing from the base 106 (e.g., spacing $d_1$).

FIG. 3A shows that in some embodiments, the footprint of the driven patch 302*a* may define the footprint of the radiating element 102. Accordingly, the parasitic patch 302*b* may have a smaller footprint than the driven patch 302*a*; in other words, $D_3$ (footprint of parasitic patch 302*b*)<$D_1$ (footprint of driven patch 302*a*). In operation, since the parasitic patch 302*b* of radiating element 102 has a larger footprint than radiating element 104 and is electrically connected to the electrically grounded center support 114, the parasitic patch 302*b* may serve as a reference plane (e.g., ground plane) for radiating element 104.

Figure 4:
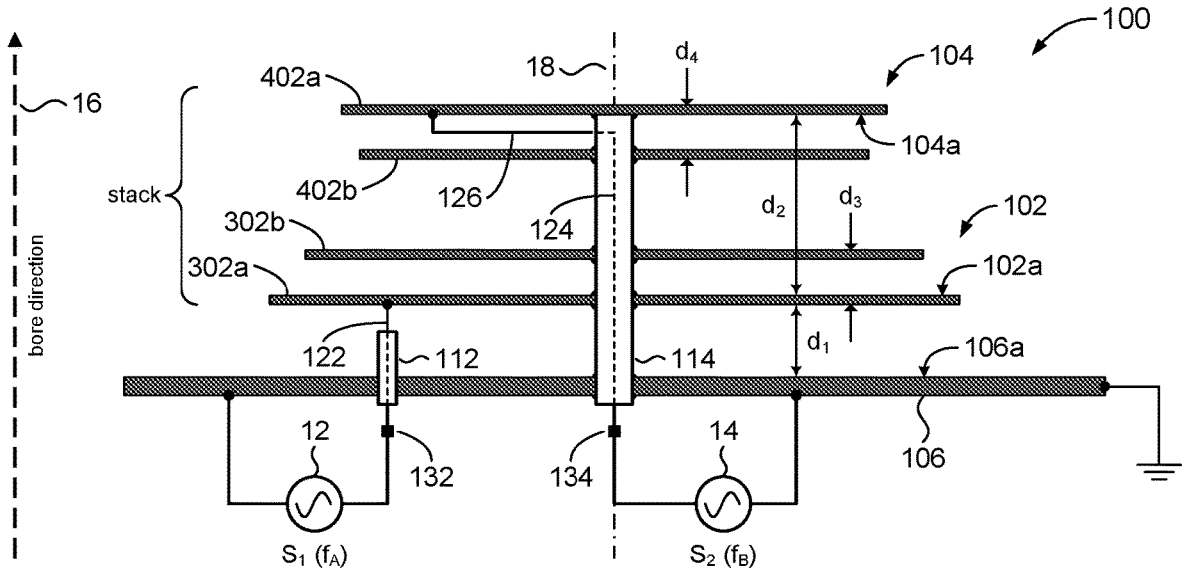
FIGS. 4 and 4A illustrate a further embodiment of a stacked self-diplexed antenna in accordance with the present disclosure.
Figure 4A:
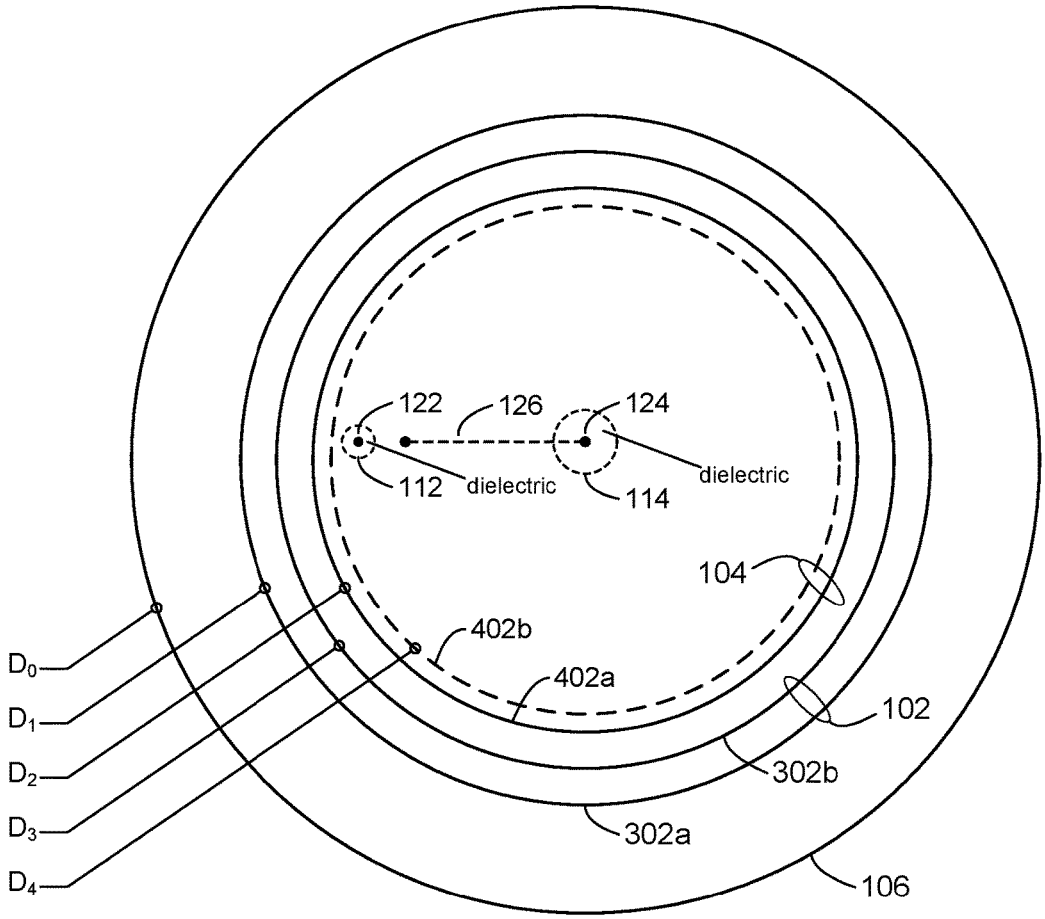

Referring to FIGS. 4 and 4A, in accordance with the present disclosure the operating frequency band of radiating element 104, likewise, may be tuned by the use of a parasitic patch. In some embodiments for example, the radiating element 104 may comprise a parasitic patch 402*b* and a driven patch 402*a* that is stacked relative to the parasitic patch 402*b* in the boresight direction 16. The driven and parasitic patches 402*a*, 402*b* may be mechanically supported by the center support 114, and may comprise any suitable electrically conductive material. The driven patch 402*a* may be fed by the feed line 124 via breakout connector 126 connected to the driven patch 402*a*. The parasitic patch 402*b* may be fed parasitically by virtue of its proximity to the driven patch 402*a*, electromagnetically coupling to the driven patch 402*a*.

The driven and parasitic patches 402*a*, 402*b* that comprise radiating element 104 may be tuned to define respective resonance frequencies in the patches 402*a*, 402*b* that can establish a desired operating frequency band for radiating element 104. For example, the tuning may include patch designs in terms of shape, dimensions, etc., and spacing (e.g., spacing $d_4$) between patches 402*a*, 402*b*.

FIG. 4A shows that in some embodiments, the footprint of the driven patch 402*a* may define the footprint of the radiating element 104. Accordingly, the parasitic patch 402*b* may have a smaller footprint than the driven patch 402*a*. More particularly, $D_4$ (footprint of parasitic patch 402*b*) may be less than $D_2$ (footprint of driven patch 402*a*). In operation, the parasitic patch 402*b* may serve as a quasi-reference plane for the driven patch 402*a*, since it has a smaller footprint than the driven patch 402*a*. However, the reference plane for the radiating element 104 as a whole is provided by the parasitic patch 302*b* component of radiating element 102, as explained above.

Figure 5A:
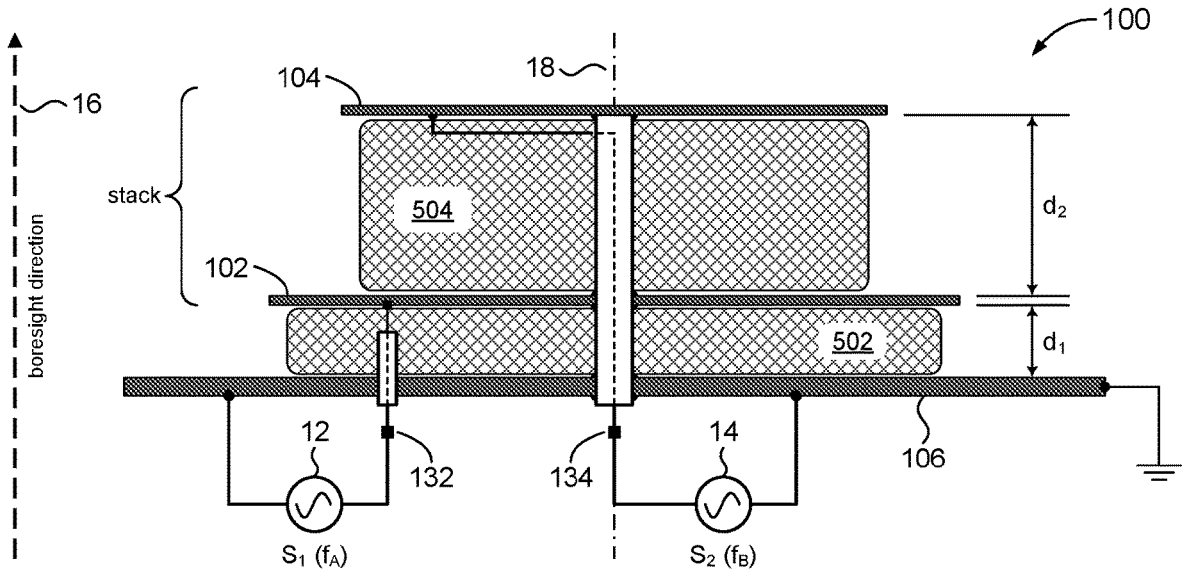
FIGS. 5A and 5B illustrate the use of dielectric spacers in a stacked self-diplexed antenna in accordance with the present disclosure.
Figure 5B:
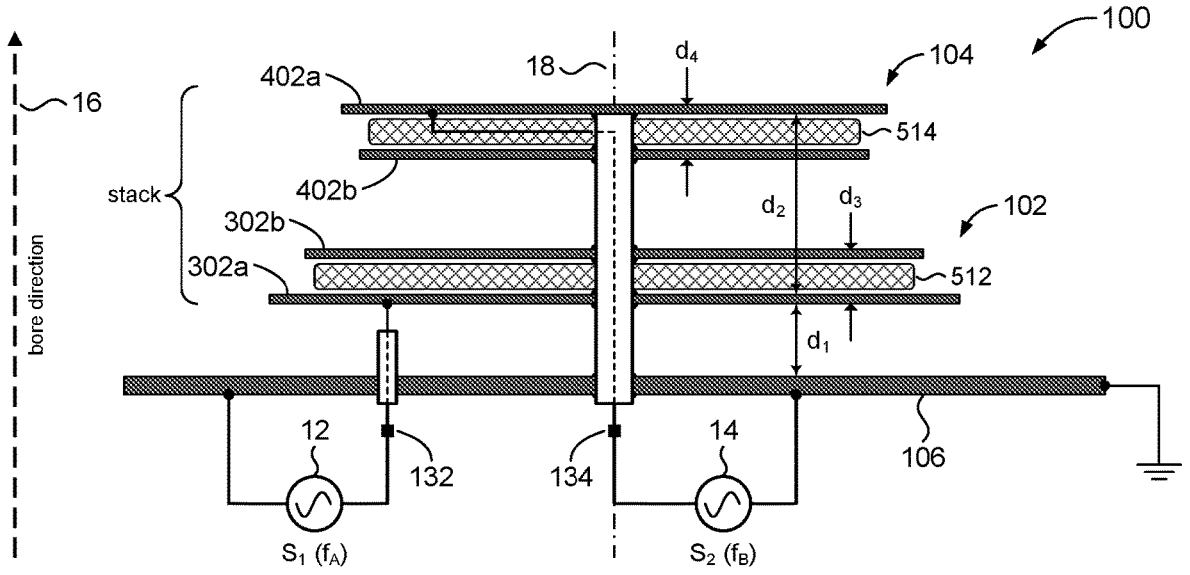

Referring to FIGS. 5A and 5B, the electrical separation, rather than the physical separation, between radiating elements 102, 104 is a determining factor for self-diplexing. The electrical length in a solid, semi-solid (e.g., plastic foam), or dielectric is shorter than in free space. A quarter-wavelength in a solid dielectric is physically shorter than a quarter-wavelength in free space at the same frequency. Accordingly, in some embodiments of the present disclosure, the physical spacing between radiating elements 102, 104 can be reduced by filling (loading) the space between the radiating elements 102, 104, fully or partly, by a dielectric, and still allow for self-diplexing operation.

FIG. 5A shows, for some embodiments, that antenna 100 may comprise a dielectric spacer 502 provided between radiating element 102 and base 106 in order to reduce the distance $d_1$. The figure also shows that in some embodiments, the antenna 100 may further comprise a dielectric spacer 504 provided between radiating element 102 and radiating element 104 in order to reduce the distance $d_2$. In other embodiments, the antenna 100 may employ only dielectric spacer 502, or only dielectric spacer 506. Reducing the distance of either $d_1$ or $d_2$ can be beneficial when packaging constraints impose a height limitation on the antenna 100.

FIG. 5B shows, for some embodiments, the antenna 100 may comprise dielectric spacers used with component patches that may comprise each radiating element 102, 104. For example, in some embodiments where radiating element 102 of antenna 100 comprises a driven patch 302*a* and a parasitic patch 302*b* as described in FIG. 3, the antenna 100 may include a dielectric spacer 512 between the patches 302*a*, 302*b*, to reduce the spacing $d_3$. Similarly, in embodiments where radiating element 104 comprises a driven patch 402*a* and a parasitic patch 402*b* (FIG. 4), the antenna 100 may include a dielectric spacer 514 between the patches 402*a*, 402*b*, to reduce the spacing $d_4$.

Figure 6:
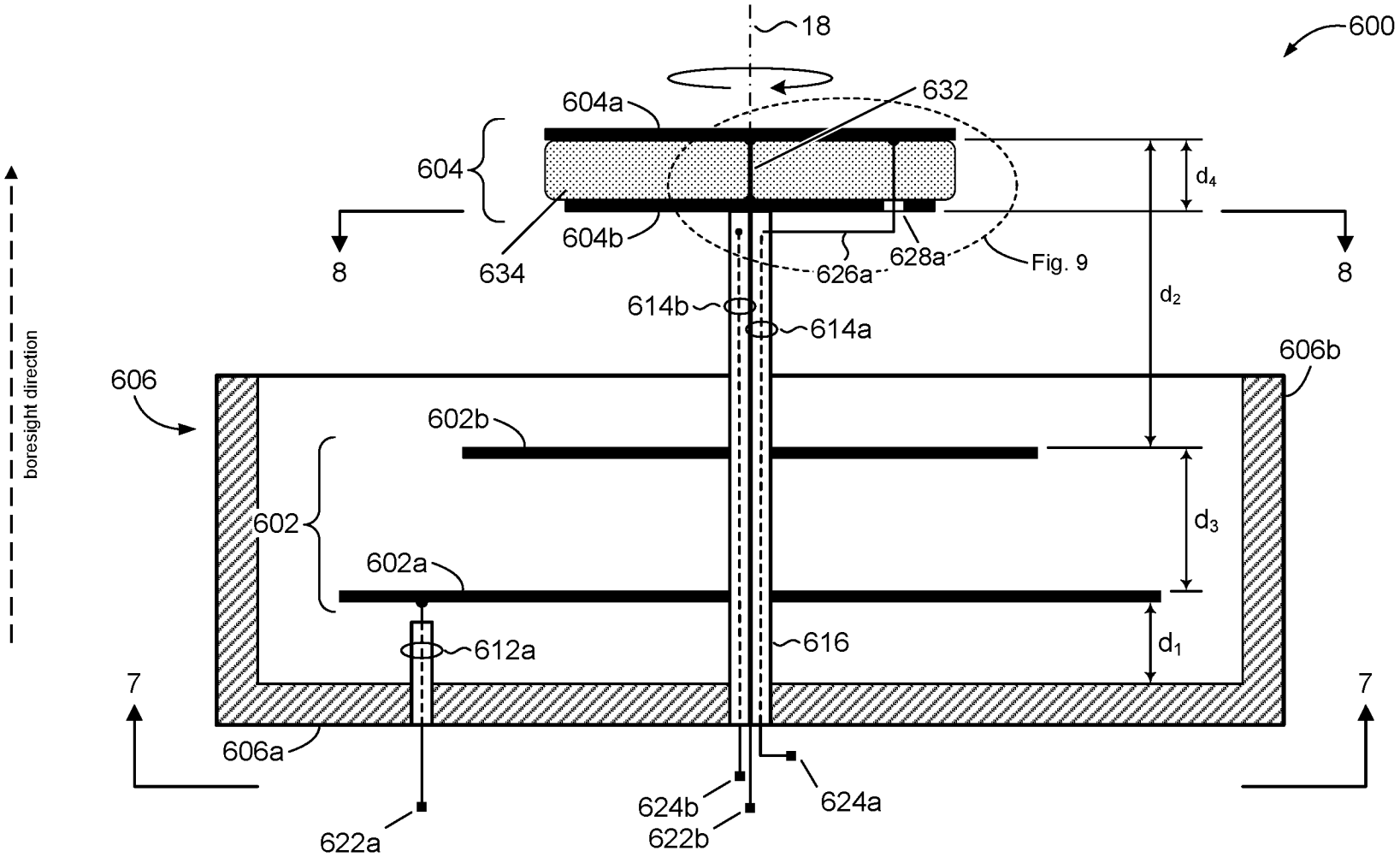
FIGS. 6 and 6A depict a schematic illustration of a particular embodiment of a stacked self-diplexed antenna in accordance with the present disclosure.
Figure 6A:
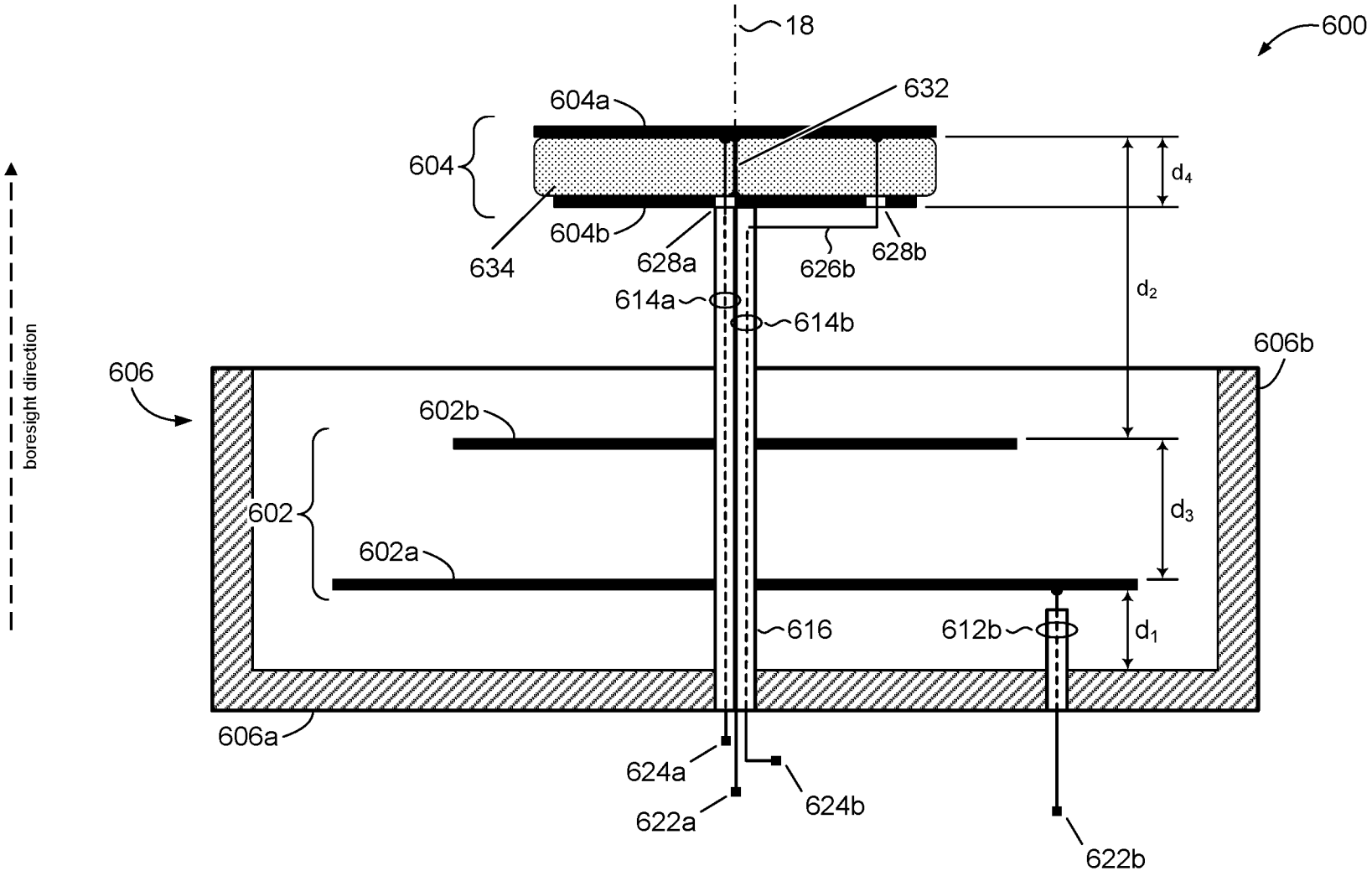

Referring to FIGS. 6 and 6A, the discussion will now turn to a description of a particular embodiment of an antenna 600 in accordance with the present disclosure to illustrate additional aspects. FIG. 6 shows the antenna 600 in cross section, viewed from a side of the antenna 600 that will be referenced as SIDE A (see also FIGS. 7 and 8). FIG. 6A shows a side of antenna 600 obtained by rotating the antenna 600 by 90° in the clockwise direction about a longitudinal axis 18 of the antenna 600.

The antenna 600 may include an electrically conductive cup (open-ended enclosure) 606 that has a base portion 606*a* and a sidewall portion 606*b*. The antenna 600 may include an electrically conductive center support 616 to provide mechanical support for a first radiating element 602 and a second radiating element 604. The first radiating element 602 may be fully contained within the interior volume of the cup 606, and elevated above the base portion 606*a* by a distance $d_1$.

The first radiating element 602 may comprise a lower patch 602*a* and an upper patch 602*b* that has a smaller footprint than the lower patch 602*a*. In some embodiments, the lower and upper patches 602*a*, 602*b* may be circular patches. In a particular embodiment, radiating element 602 may be configured (e.g., based on size of patches 602*a*, 602*b*, separation $d_3$ between patches 602*a*, 602*b*, etc.) to operate in the E5/E6 frequency bands, covering a bandwidth of about 1.145-1.304 GHz. The lower patch 602*a* may be the driven patch, and the upper patch 602*b* may be fed parasitically, by virtue of electromagnetic coupling to the lower patch 602*a* as well as cup 606.

The lower patch 602*a* may be driven in quadrature via two coaxial transmission lines 612*a* (FIGS. 6) and 612*b* (FIG. 6A) connected at different locations on the lower patch 602*a*, to provide for operation with circular polarization. FIG. 6 shows the transmission line 612*a* attached at a first location on radiating element 602. In FIG. 6, the transmission line 612*b* is obscured by the center support 616. However, in the 90° clockwise rotated view of FIG. 6A, the transmission line 612*b* is shown attached at a second location on radiating element 602. In a particular embodiment, each transmission line 612*a*, 612*b* may comprise a wire supported in a dielectric material and encased in an electrically conductive sheath. In some embodiments, the dielectric material may be Laird Eccostock® 0005 dielectric material.

Figure 7:
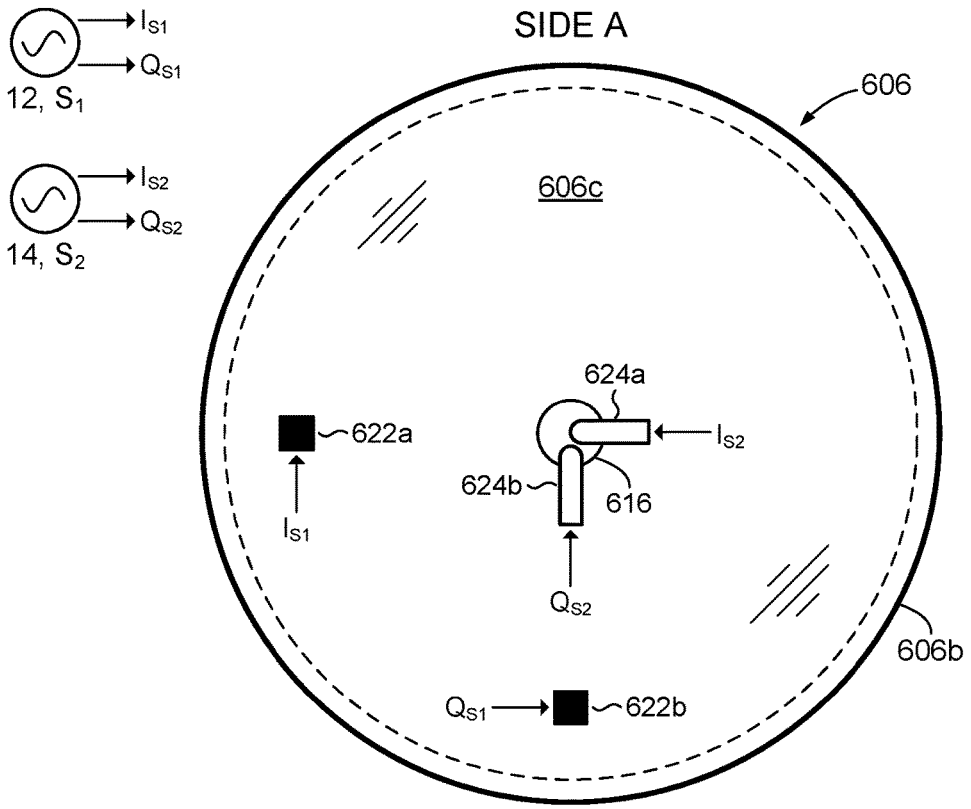
FIG. 7 shows an arrangement of the ports of a particular embodiment of a stacked self-diplexed antenna in accordance with the present disclosure.

The input ports 622*a*, 622*b* of respective transmission lines 612*a*, 612*b* may be provided through the base portion 606*a* of cup 606. Referring for a moment to FIG. 7, the exterior bottom surface 606*c* of cup 606 is shown, viewed along view line 7-7 shown in FIG. 6. FIG. 7 indicates the relative locations of the input ports 622*a*, 622*b* on the bottom surface 606*c* of cup 606. The drive signals may be produced by signal sources, 12, 14. A signal source 12 may produce an in-phase signal $I_{S1}$ and a quadrature-phase signal $Q_{S1}$, which may be fed respectively to input ports 622*a*, 622*b*. In accordance with the present disclosure, the quadrature signals $I_{S1}$ and $Q_{S1}$ may be fed directly to radiating element 602 without a diplexer. As explained above, however, it will be appreciated that there may be other kinds of intervening circuitry between radiating element 602 and the signal source $S_1$, such as couplers, filters, or other such signal conditioning circuits.

In some embodiments, the cup 606 may serve as a reference plane (e.g., ground plane) for radiating element 602. In an arrayed configuration (not shown) comprising an array of antennae 600, the cup 606 for each antenna 600 in the array may contribute to containing the energy radiated by radiating element 602 within a small footprint so as to reduce mutual coupling with nearby antennas in the array. The diameters of the lower and upper patches 602*a*, 602*b* of radiating element 602 and their elevations above the base portion 606*a* of cup 606 may be design parameters that can be tuned to provide two suitably positioned resonances adequate for supporting the combined E5/E6 bands. The lower and upper patches 602*a*, 602*b* may be mechanically supported above the base portion 606*a* of cup 606 by the center support (tube) 616 arising from the base portion 606*a*.

In some embodiments, the center support 616 may be electrically conducting, made of the same metal (e.g., aluminum) as the cup 606 and the radiating elements 602, 604. Since the electrical potentials at the centers of the radiating elements 602, 604 at their respective fundamental resonant frequencies are equal to the electrical potential at the center of the cup 606 (i.e., the electric voltages between the radiating element centers and the cup 606 center are zero), the center support 616 is, for the most part, essentially benign from a radio frequency (RF) point of view, as long as its diameter is not excessive.

The second radiating element 604 may comprise an upper patch 604*a* and a lower patch 604*b* that has a smaller footprint than upper patch 604*a*. In some embodiments, the upper and lower patches 604*a*, 604*b* may be circular patches. In a particular embodiment, radiating element 604 may be configured (e.g., based on the sizes of patches 604*a*, 604*b*, separation $d_4$ between patches 604*a*, 604*b*, etc.) to operate in the E1 frequency band, covering a bandwidth of about 1.550-1.601 GHz.

The upper and lower patches 604*a*, 604*b* may be elevated above the cup 606 and mechanically supported above the cup 606 by the center support 616. However, since the center support 616 and the upper and lower patches 604*a*, 604*b* are electrically conductive, the upper and lower patches 604*a*, 604*b* and the portion of the center support 616 that extends above the radiating element 602 can degrade the axial ratio of circularly-polarized waves generated by the radiating element 602. Therefore, in some embodiments, the radiating element 604 may include a dielectric material 634 disposed between its upper and lower patches 604*a*, 604*b* to reduce the physical size of the upper and lower patches 604*a*, 604*b* and in this way reduce the degradation in polarization. In some embodiments, for example, the dielectric material 634 may be Laird Eccostock® HiK dielectric material, having a high relative dielectric constant such that the diameters of the upper and lower patches 604*a*, 604*b* can be reduced in size in order to reduce degradation in the axial ratio of circularly-polarized waves generated by radiating element 602. However, a radiating element 604 having smaller sized upper and lower patches 604*a*, 604*b* will exhibit reduced peak gain performance as compared to larger sized upper and lower patches 604*a*, 604*b*. Accordingly in some embodiments, a relative dielectric constant of 3 for dielectric material 634 may be deemed to be a reasonable compromise between these two mutually opposing goals: reducing degradation in circularly-polarized waves generated by radiating element 602 to within tolerable levels and providing adequate peak gain performance for radiating element 604. In some embodiments, a dielectric material (e.g., 504, FIG. 5A) may be disposed between radiating elements 602, 604. Likewise, a dielectric material (e.g., 502, FIG. 5A) may be disposed between radiating element 602 and base portion 606*a*. Similarly, a dielectric material (e.g., 514, FIG. 5B) may be disposed between the lower and upper patches 602*a*, 602*b* of radiating element 602.

The lower patch 604*b* of radiating element 604 may serve to widen the input impedance bandwidth of the radiating element 604. Specifically, one resonance is provided by the upper patch 604*a*, and a second resonance is introduced by the inductance of the feeding wires 626*a*, 626*b* in combination with [A] the capacitance of the feeding wires 626*a*, 626*b* with respect to the surfaces of the cutouts in the center support 616 (FIG. 8), [B] the capacitance of the microstrip-like lines formed by the feeding wires 626*a*, 626*b* and the bottom surface of the lower patch 604*b*, and [C] the capacitance of transitions formed by the feeding wires 626*a*, 626*b* and the respective openings 628*a*, 628*b* in the lower patch 604*b*. The lower patch 604*b* of radiating element 604 may also be viewed as a "quasi-reference" (ground) plane for the upper patch 604*a* (the lower patch 604*b* is smaller in diameter than the upper patch 604*a*). The actual reference plane for the radiating element 604 as a whole, however, may be provided by upper patch 602*b* of radiating element 602. In order not to leave the upper patch 604*a* of radiating element 604 electrically floating, the upper patch 604*a* may be shorted to the lower patch 604*b* by a centrally located shorting pin 632. Since the voltage between the two patches at the pin's location is zero in the fundamental resonance of the upper patch 604*a*, the shorting pin 632 has no detrimental effects on the RF performance of the radiating element 604 as a whole.

The upper patch 604*a* of radiating element 604 may be driven in quadrature by two coaxial transmission lines 614*a*, 614*b*, formed in conjunction with the center support 616, to provide for operation with circular polarization. The transmission lines 614*a*, 614*b* may be threaded through respective openings formed through the lower patch 604*b* of radiating element 604 to connect with the upper patch 614*a*. It is in this sense that the lower patch 604*b* may be referred to as a "quasi-reference" plane for the upper patch 604*a*. The signal for driving radiating element 604 may be provided to the transmission lines 614*a*, 614*b* via their respective input ports 624*a*, 624*b*.

FIG. 6 shows that a breakout wire 626*a* may connect to transmission line 614*a* near the center support 616, and extend from the center support 616 toward the periphery of the radiating element 604. The breakout wire 626*a* may pass through an opening 628*a* formed at a first location through the lower patch 604*b*, to make an electrical connection at a first location on the upper patch 604*a*. Likewise, referring to the 90° clockwise rotated view of FIG. 6A, a breakout wire 626*b* may connect to the transmission line 614*b* and extend toward the periphery of the radiating element 604. The breakout wire 626*b* may pass through an opening 628*b* formed through the lower patch 604*b* at a second location, to make a connection at a second location on the upper patch 604*a*.

Figure 8:
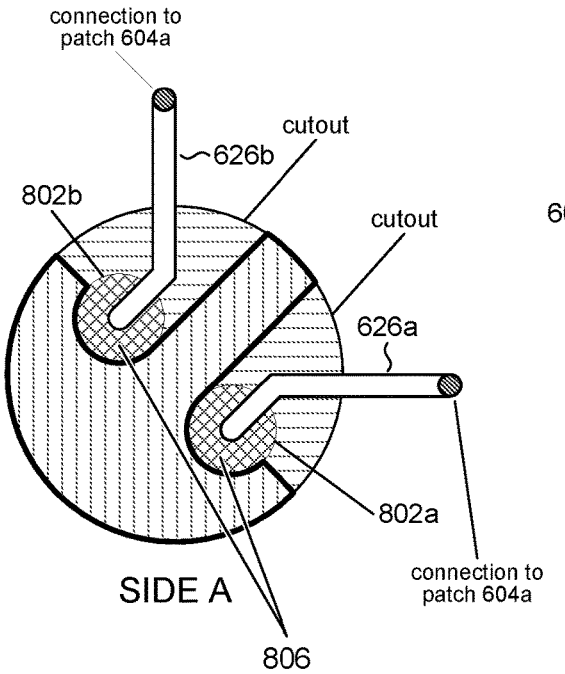
FIG. 8 is a cross-sectional view of the center support component in a particular embodiment of a stacked self-diplexed antenna in accordance with the present disclosure.
Figure 9:
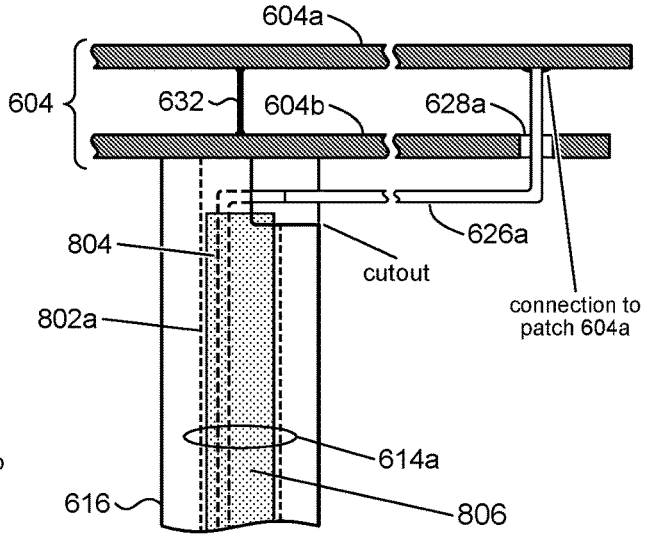
FIG. 9 shows details for connecting transmission lines to an upper radiating element in a particular embodiment of a stacked self-diplexed antenna in accordance with the present disclosure.

Additional details of the transmission lines 614*a*, 614*b* in accordance with the present disclosure are shown in FIGS. 8 and 9. FIG. 8 shows a cross sectional view of the center support 616 taken along view line 8-8 shown in FIG. 6. FIG. 9 provides additional detail of the circled area shown in FIG. 6. The transmission lines 614*a*, 614*b* may be integrated with the center support 616. In some embodiments, for example, shafts 802*a*, 802*b* may be formed through the center support 616 along its axial length. The shafts 802*a*, 802*b* may be filled with a suitable dielectric material 806. In some embodiments, for example, the dielectric material 806 may be Laird Eccostock® 0005 dielectric material. Each transmission line 614*a*, 614*b* may include a wire that runs inside its respective shaft 802*a*, 802*b*, supported by the dielectric material 806; FIG. 9, for example, shows wire 804 comprising transmission line 614*a* provided within shaft 802*a*.

The wires in each transmission line 614*a*, 614*b* may radially break out as respective breakout wires 626*a*, 626*b* near the top of the center support 616, beneath the lower patch 604*b* of radiating element 604. In some embodiments, for example, the cutouts may be formed in the center support 616 to allow the wires (e.g., 804) to be broken out. From the cutouts, the breakout wires 626*a*, 626*b* may run parallel to, and underneath, the lower patch 604*b*. Each breakout wire 626*a*, 626*b* may pass through a respective opening 628*a*, 628*b* formed through the lower path 604*b* of radiating element 604 to connect with the upper patch 604*a* of radiating element 604. FIG. 9, for example, shows the breakout wire 626*a* for transmission line 614*a*, running from the cutout of center support 616 toward the periphery. The breakout wire 626*a* passes through opening 628*a* formed through the lower patch 604*b* of radiating element 604 to make an electrical connection with upper patch 604*a* of radiating element 604.

In accordance with the present disclosure, the second radiating element 604 may be spaced apart from radiating element 602 in the boresight direction by a spacing $d_2$. As explained above, the spacing $d_2$ is such that the isolation between ports 622*a*, 622*b* of radiating element 602 and ports 624*a*, 624*b* of radiating element 604 is greater than or equal to 15 dB in both operating frequency bands (i.e., E5/E6 and E1) of the antenna 600. In some embodiments, the spacing $d_2$ may be between a quarter wavelength in the frequency band of radiating element 604 and a quarter wavelength in the frequency band of radiating element 602. Merely to illustrate this point, suppose the radiating element 602 is tuned to an operating frequency band in the range 1.145-1.304 GHz and the radiating element 604 is tuned to an operating frequency band in the range 1.550-1.601 GHz. A quarter-wavelength in the first band is between 5.7 cm and 6.6 cm, whereas a quarter-wavelength in the second band it is between 4.7 cm and 4.8 cm.

As explained above, the reciprocity theorem states that the mutual interaction between the radiating elements 602, 604 is the same regardless of whether a signal is fed to ports 622*a*, 622*b* and a response is monitored at ports 624*a*, 624*b*, or a signal is fed to ports 624*a*, 624*b* and a response is monitored at ports 622*a*, 622*b*. Given that the quarter-wavelength figures in the two operating frequency bands are not identical, the reciprocity theorem implies it is not possible to get full self-diplexing in the antenna; i.e., zero response observed in the ports 624*a*, 624*b* of radiating element 604 across the operating frequency band of radiating element 604 when radiating element 602 is fed, and vice versa) in both operating frequency bands.

Useful values of self-diplexing may be deemed to be greater than or equal to 15 dB. For example, a separation $d_2$ of 4.7 cm can result in measured self-diplexing between 16 and 17 dB in both operating frequency bands. If the separation $d_2$ is substantially increased, eventually radiating element 604 will be so far away from radiating element 602 that the EM fields radiated by radiating element 602 induce only miniscule electric currents on the surface of radiating element 604, and vice versa. Such a large separation, however, is measured on the order of several whole wavelengths, and radiating elements 602, 604 are not in mutual proximity. This is referred to as EM isolation by spatial separation. The resulting antenna would have a very large profile, and may be deemed impractical.

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. An antenna comprising:

a housing having a closed end and an open end opposite the closed end;

a first radiating element overlying a bottom of the closed end of the housing, the first radiating element having a footprint smaller than the bottom of the housing, the first radiating element operative to communicate signals in a first frequency band;

a first feed line in communication with the first radiating element and operative to communicate signals with the first radiating element that correspond to a first polarization;

a second radiating element overlying the first radiating element and having a footprint smaller than the first radiating element, the second radiating element operative to communicate signals in a second frequency band; and a second feed line in communication with the second radiating element and operative to communicate signals with the second radiating element that correspond to the first polarization;

the first and second radiating elements separated by a distance such that isolation between the first and second feed lines in the first and second frequency bands is greater than or equal to 15 dB.

2. The antenna according to claim 1, wherein the distance between the first radiating element and the second radiating element is in a range between one quarter wavelength of a first frequency in the first frequency band and one quarter wavelength of a second frequency in the second frequency band.

3. The antenna according to claim 1, wherein the distance between the first radiating element and the second radiating element is at most one quarter wavelength of a frequency in the first frequency band.

4. The antenna according to claim 1, wherein the first radiating element comprises a first radiator and a second radiator overlying the first radiator, wherein the first frequency band of the first radiating element is based on a spacing between the first and second radiators of the first radiating element.

5. The antenna according to claim 1, wherein the second radiating element comprises a first radiator and a second radiator overlying the first radiator, wherein the second frequency band of the second radiating element is based on a spacing between the first and second radiators the second radiating element.

6. The antenna according to claim 1, further comprising a dielectric material disposed between the first radiating element and the second radiating element.

7. An antenna comprising:

an electrically conductive surface;

a first radiating element overlying the electrically conductive surface and having a footprint smaller than the electrically conductive surface, the first radiating element operative in a first frequency band, the first radiating element including a first feed line to communicate a first signal corresponding to a first polarization; and a second radiating element overlying the first radiating element and having a footprint smaller than the first radiating element, the second radiating element operative in a second frequency band, the second radiating element including a second feed line to communicate a second signal corresponding to the first polarization, wherein a distance between the first radiating element and the second radiating element is in a range between one quarter wavelength of a first frequency in the first frequency band and one quarter wavelength of a second frequency in the second frequency band.

8. The antenna according to claim 7, wherein the second radiating element directly overlies the first radiating element.

9. The antenna according to claim 7, wherein the footprint of the second radiating element lies entirely within the footprint of the first radiating element.

10. The antenna according to claim 7, wherein isolation between the first and second feed lines in the first and second frequency bands is greater than or equal to 15 dB.

11. The antenna according to claim 7, wherein the distance between the first radiating element and the second radiating element is equal to at most one quarter wavelength of a first frequency in the first frequency band.

12. The antenna according to claim 7, wherein the first and second frequency bands are determined in part by respective dimensions of the first and second radiating elements.

13. The antenna according to claim 7, wherein the first radiating element comprises a first radiator and a second radiator overlying the first radiator, wherein the first frequency band of the first radiating element is based on a spacing between the first and second radiators of the first radiating element.

14. The antenna according to claim 13, wherein a footprint of the second radiator is smaller than the first radiator and larger than the second radiating element.

15. The antenna according to claim 7, wherein the second radiating element comprises a first radiator and a second radiator overlying the first radiator, wherein the second frequency band of the second radiating element is based on a spacing between the first and second radiators of the second radiating element.

16. The antenna according to claim 15, further comprising a shorting pin connected to the first and second radiators of the second radiating element.

17. The antenna according to claim 7, wherein the first and second radiating elements are patches or dipoles.

18. The antenna according to claim 7, wherein one of the first and second radiating elements is a patch and the other of the first and second radiating elements is a dipole.

19. The antenna according to claim 7, further comprising a dielectric material disposed between the first and second radiating elements.

* * * * *